United States Patent [19]

Okamoto

[11] 3,934,172

[45] Jan. 20, 1976

[54] FLAT DISCHARGE PANEL USING D.C. DISCHARGE, AND METHOD OF DRIVING THE SAME

[75] Inventor: Yukio Okamoto, Hachioji, Japan

[73] Assignee: Hitachi, Ltd., Japan

[22] Filed: Dec. 12, 1974

[21] Appl. No.: 532,176

[30] Foreign Application Priority Data

Dec. 12, 1973 Japan ..... 48-137782

[52] U.S. Cl. ..... 315/169 TV; 313/188; 313/217; 313/220; 313/485

[51] Int. Cl.[2] ..... H01J 17/04; H01J 61/06

[58] Field of Search ..... 315/169 TV; 313/188, 217, 313/220, 485

[56] References Cited

UNITED STATES PATENTS 3,771,008 11/1973 Chen et al. ..... 313/188

*Primary Examiner*—John Kominski

*Attorney, Agent, or Firm*—Craig & Antonelli

[57] ABSTRACT

A flat discharge panel comprises a plurality of cathodes parallel to one another, a plurality of intermediate electrodes each of which intersects the cathodes, and has holes at parts intersecting with the respective cathodes and which are parallel to one another. Anodes are disposed on the sides of the intermediate electrodes remote from the cathodes in a manner to be respectively parallel with the cathodes and auxiliary discharge spaces are provided for the respective cathodes. Main discharge spaces are provided in the anodes in correspondence with the respective priming holes of the intermediate electrodes, so that principally electrons in plasma, created in the auxiliary discharge space, are diffused and accelerated into the main discharge space. A method of driving the flat discharge panel including scanning, based on the transfer of the glow of the auxiliary discharge, is carried out by the use of the intermediate electrodes.

10 Claims, 10 Drawing Figures

FLAT DISCHARGE PANEL USING D.C. DISCHARGE, AND METHOD OF DRIVING THE SAME

BACKGROUND OF THE INVENTION

1. Field of the Invention

This invention relates to a flat discharge panel in which the main discharge is induced by electrons diffusing from the auxiliary discharge, and to a method of driving the flat discharge panel.

2. Description of the Prior Art

A prior-art flat discharge panel has the fundamental construction as shown by the sectional view of FIG. 1. An auxiliary discharge space 2 is formed between an auxiliary anode 13 and a cathode 3. A main discharge space 7 is formed by a space in an insulating plate 6 between the cathode 3 and an anode 9. These spaces are, of course, filled with a well known discharge gas. The discharge space consisting of the auxiliary discharge space 2 and the main discharge space 7, is a part which corresponds to a picture element for displaying a letter, character, numeral or television picture. Numeral 8 designates a phosphor which is applied on the side wall of the insulating plate 6 in the main discharge space. In order to display, for example, a television picture by such discharge spaces, predetermined voltages for effecting a discharge in the respective discharge spaces and for scanning due to the transfer of the discharge by the cathodes 3 are impressed on the respective electrodes. That is, a D.C. voltage I, having a magnitude of 250 volts, is applied from a terminal S through a resistor $R_S$ to the auxiliary anode 13. A pulse voltage II, having an amplitude of 100 volts, is applied from a terminal K to the cathode 3. A pulse voltage III, having an amplitude of 120 volts, is applied from a terminal A through a resistor $R_A$ to the anode 9. By the voltage applied between the auxiliary anode 13 and the cathode 3, plasma is produced in the auxiliary discharge space 2. Ions, principally, in the plasma diffuse into the main discharge space 7, and a main discharge is created. The creation of the main discharge is effected by the secondary discharge mechanism in which the secondary electrons generated by the diffusing ions are the initial electrons at the beginning of the main discharge. For this reason, transitional characteristics of the main discharge such as formative lag and time lag must still be improved. Further problems are the energy efficiency of the discharge, the quantity of ultraviolet rays to be radiated, and the efficiency of the phosphor excitation attributable to the small quantity of radiation.

Also, as a driving method for performing the scanning in the display device as shown in FIG. 1, there is employed the self-scanning method (the method of transferring the glow discharge forming the auxiliary discharge as is generally adopted in the devices of this type.) The outline of the self-scanning method will be explained with reference to FIG. 2 which illustrates only the electrode arrangement of the prior-art device. The auxiliary discharge glow created by the voltage applied between the auxiliary anode 13 and the cathode 3 is transferred by the potentials of the cathodes 3 or $K_R$, $K_1$,$K_2$ . . . . The device is of the cathode transfer type in which, as illustrated in FIG. 2, one of the cathodes 3 located at one end is a resetting cathode $K_R$. Cathodes $K_1$, $K_4$, $K_7$ . . . $K_2$,$K_5$,$K_8$ . . . and $K_3$,$K_6$,$K_9$ . . . of the remaining cathodes $K_1$,$K_2$,$K_3$ . . . are respectively commonly connected in three-phase connection, and the auxiliary discharge glow is successively transferred by impressing a reset pulse on a resetting cathode terminal $K_{\phi R}$ and pulses on terminals $K_{\phi 1}$, $K_{\phi 2}$ and $K_{\phi 3}$ of the respective phases. In order to raise the scanning speed with this prior-art driving method, the glow discharge must be intensified by making the auxiliary discharge current large. However, even when the auxiliary discharge current is made large, the luminance in the main discharge space does not increase. The luminous efficiency of the overall device is, therefore, lowered.

SUMMARY OF THE INVENTION

An object of this invention is to provide a flat discharge panel having improved transitional characteristics for the main discharge, and a driving method therefor.

Another object of this invention is to provide a flat discharge panel enhancing the energy efficiency of the discharge or the luminous efficiency of the device, and a driving method therefor.

This invention for accomplishing such objects is characterized in that electrons in plasma produced in an auxuiliary discharge space are diffused into a main discharge space to thus induce the main discharge by the electrons, and that the anode transfer type is adopted in which the auxiliary discharge glow is transferred by the use of intermediate electrodes.

Hereunder this invention will be described in detail with reference to the drawings.

DESCRIPTION OF THE PREFERRED EMBODIMENTS

Figure 3:
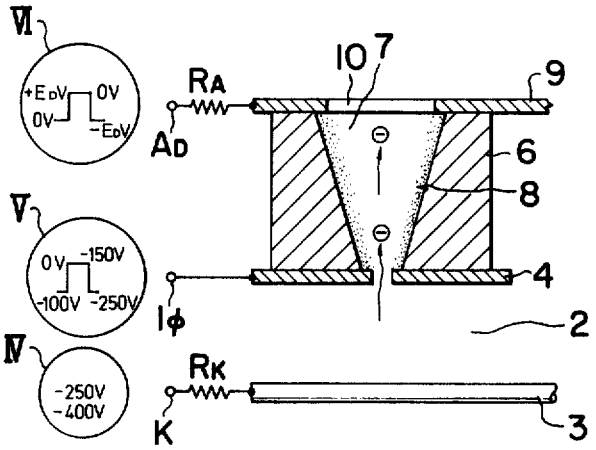
FIG. 3 is a sectional view showing the fundamental construction of a flat discharge panel according to this invention.

FIG. 3 is a sectional view which shows the fundamental construction of a flat discharge panel according to this invention. An intermediate electrode 4 is arranged between anode 9 and cathode 3. The auxiliary discharge is increased between cathode 3 and intermediate electrode 4. The main discharge is carried out between anode 9 and intermediate electrode 4. A space in insulating plate 6 between the anode 9 and the intermediate electrode 4 forms a main discharge space. Numeral 10 indicates a display hole which is formed in the anode 9 and which serves also as part of the main discharge space. For transferring the auxiliary discharge flow, a D.C. voltage IV whose magnitude is, for example, −250volts (or − 400 volts) is applied from a terminal K through a resistor $R_K$ to the cathode 3, a pulse voltage V whose magnitude changes, for example, from −100 volts (or −250 volts) to 0 volts (or −150 volts) is applied from a terminal $I_\phi$ to the intermediate electrode 4, and a pulse voltage VI whose magnitude changes, for example, from 0 volts (or − $E_D$ volts) to + $E_D$ volts (or 0 volts) is applied from a terminal $A_D$ through a resistor $R_A$ to the anode 9. With such construction, ions in plasma, principally, produced in the auxiliary discharge space 2 by the voltage applied between the cathode 3 and the intermediate electrode 4 diffuse into the main discharge space 7. Under the control of the potential difference between the intermediate electrode 4 and the anode 9, a positive column-like discharge being an abundant ultraviolet ray source can be formed in the main discharge space. A further advantage is that, since the flat discharge panel cannot maintain the main discharge by the main discharge alone, the display resistor $R_A$ is unnecessary in principle. A still further advantage is that, since a potential drop in the scanning resistor $R_K$ performs the current feedback action, the discharge can be stably maintained.

Figure 1:
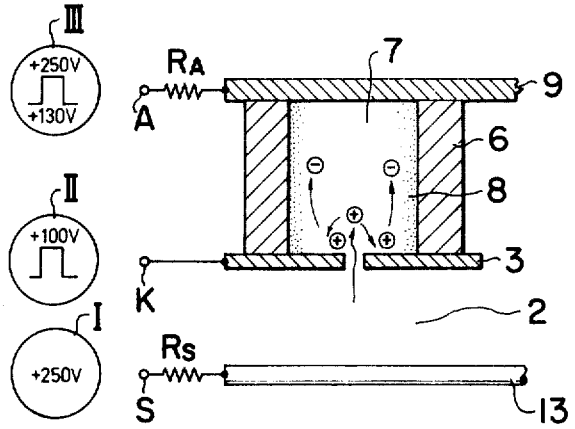
FIG. 1 PRIOR ART
FIG. 1 is a sectional view showing the fundamental construction of a prior-art flat discharge panel.
Figure 2:
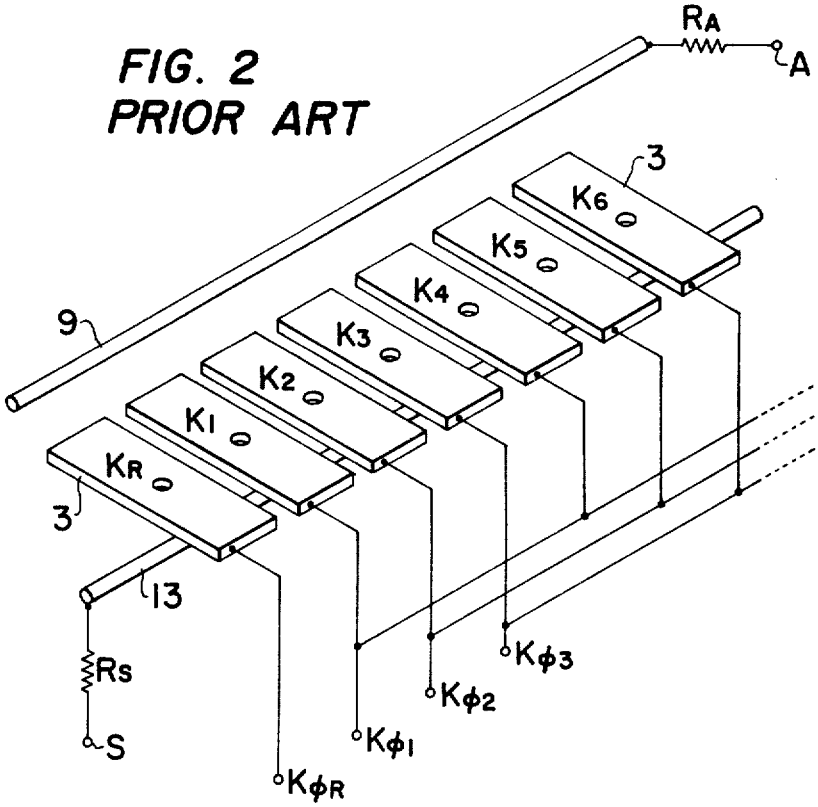
FIG. 2 PRIOR ART
FIG. 2 is a perspective view for explaining a method of driving the prior-art device shown in FIG. 1.
Figure 4:
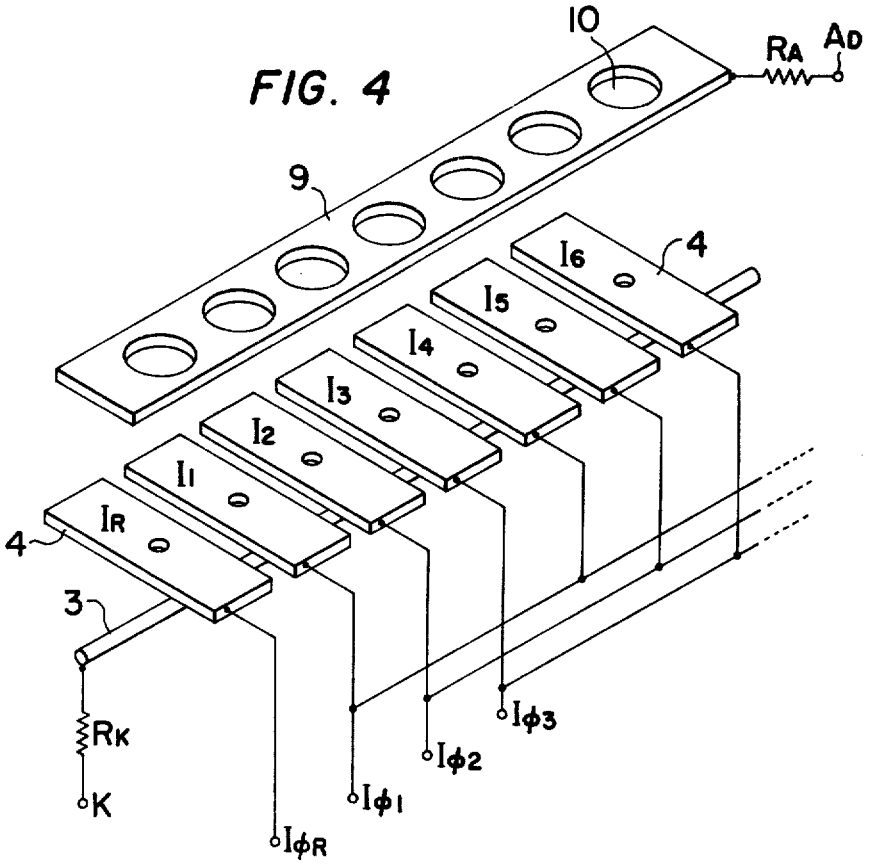
FIG. 4 is a perspective view for explaining a driving method according to this invention.

FIG. 4 is a view for explaining the driving method of this invention for the device shown in FIG. 3, the method adopting the self-scanning of the anode transfer type which employs the intermediate electrodes. It shows only an electrode arrangement similarly to FIG. 2.

Figure 6:
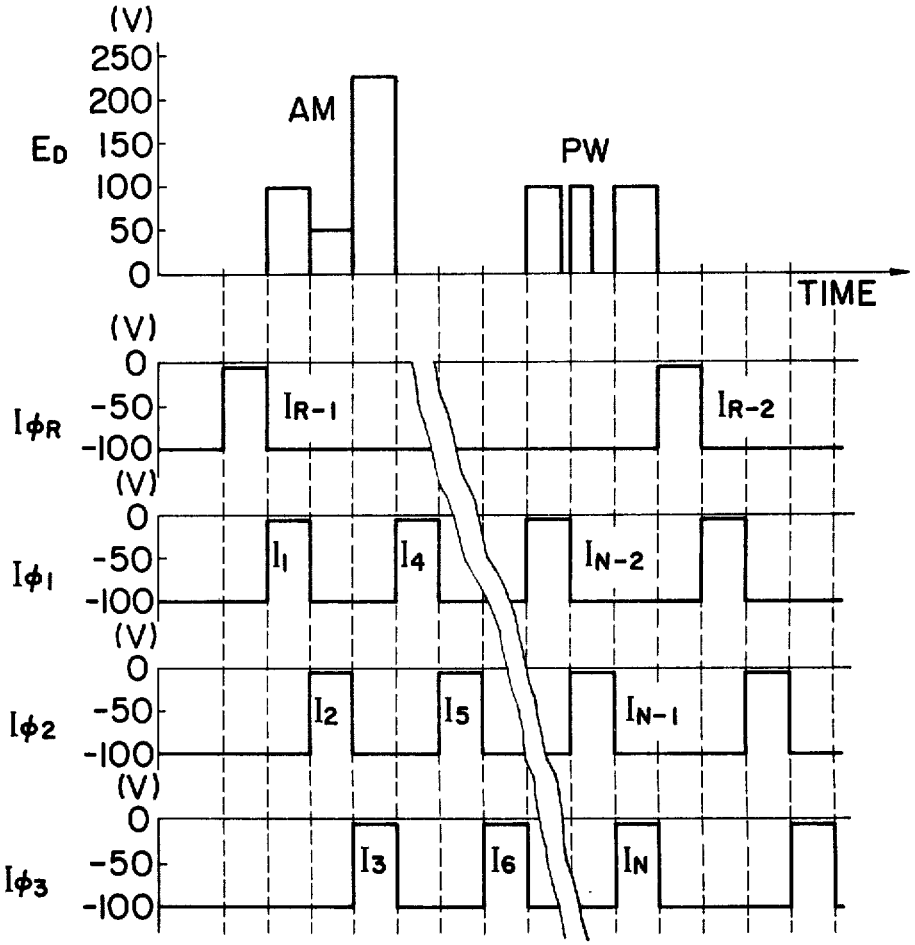
FIG. 6 is a diagram showing driving waveforms for use in the driving method according to this invention.

In FIG. 4, a large number of intermediate electrodes 4 are provided. The intermediate electrode $I_R$ at one end of the array is used for resetting. The remaining intermediate electrodes $I_1, I_2, I_3 \ldots$ are divided into, for example, three blocks namely, the block $(I_1, I_4, I_7 \ldots)$, the block $(I_2, I_5, I_8 \ldots)$ and the block $(I_3, I_6, I_9 \ldots)$. Pulse signals $I_{\phi 1}$, $I_{\phi 2}$, and $I_{\phi 3}$ as shown by way of example in FIG. 6, are supplied to the terminals $I_{\phi 1}'$, $I_{\phi 2}'$, and $I_{\phi 3}'$ of the respective blocks. A pulse signal $I_{\phi R}$, as shown by way of example in FIG. 6, is applied from a resetting terminal $I_{\phi R}'$ to the resetting intermediate electrode $I_R$.

On the other hand, the voltage $E_D$ to be applied to the anode for the display is synchronized with the signal voltages of the intermediate electrodes, as illustrated by way of example in FIG. 6. It is supplied to the anode terminal $A_D$ in FIG. 3 by the use, of for example, a constant current source. As indicated at AM or PW in FIG. 6, the brilliance modulation of the display is effected through pulse peaks (amplitude modulation) or pulse widths or pulse numbers (current modulation) corresponding to input signals. The brilliance modulation may also be made by the combination of these modulations.

When, in this manner, the self-scanning method of the anode transfer type in which the potentials of the intermediate electrodes 4 are transferred is used, the ionization coupling indispensable to the self-transfer can be enhanced, as will be described with reference to FIGS. 5*a* and 5*b*. This brings forth such advantages that low voltage drive is possible and that the scanning speed can be made high.

Figure 5A:
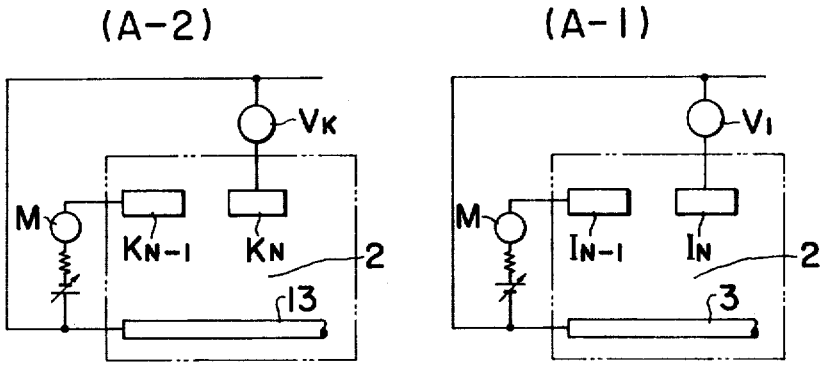
FIG. 5*a* and 5*b* are diagrams for explaining ionization couplings attained in the devices of this invention and the prior art.

(A-1) and (A-2) in FIG. 5*a* are circuits for measuring the degrees of ionization coupling in the self-scanning methods of the anode transfer type of this invention and the cathode transfer type of the prior art, respectively. FIG. 5*b* shows an example of characteristic diagram in which the measurement results under the same conditions are compared. Here, $V_I$ and $V_K$ denote voltmeters for measuring floating potentials applied to the N-th intermediate electrode and cathode, respectively, while M denotes an ammeter for measuring an auxiliary discharge current.

With the anode transfer type of device according to this invention, when a discharge is produced between the cathode 3 and the (N−1) -th one of the intermediate electrodes 4 provided in opposition to the common cathode 3, charged particles consisting chiefly of metastable atoms, of a long life time, diffuse along the auxiliary discharge space 2, and they charge the adjacent N-th intermediate electrode $I_N$ to a positive potential. Consequently, in comparison with a case where no discharge takes place between the cathode 3 and the (N−1)-th intermediate electrode $I_{N-1}$, the voltage to be externally applied for the firing or the initiation of a discharge between the cathode 3 and the N-th intermediate electrode $I_N$ may be smaller in value to that extent. For this reason, when a certain voltage is applied to the (N−1)-th intermediate electrode $I_{N-1}$ so as to induce a discharge, a discharge between the adjacent N-th intermediate electrode $I_N$ and the cathode 3 is thereby promoted. When the same voltage as that of the electrode $I_{N-1}$ is applied to the electrode $I_N$ transfer is facilitated.

Figure 5B:
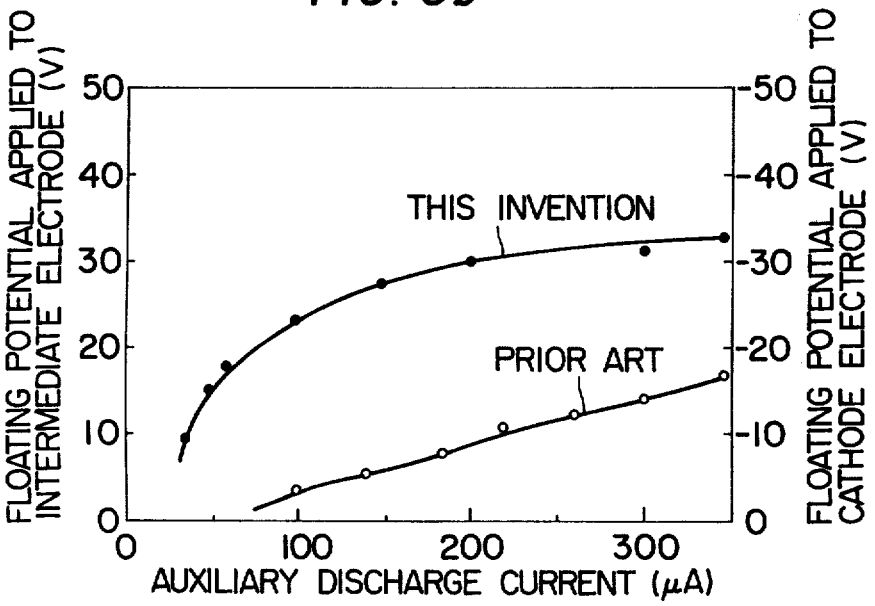

As is understood from the characteristic curves shown in FIG. 5b, the quantity of charges to which the adjacent intermediate electrode is charged up or the floating potential of the adjacent intermediate electrode is much greater for the anode transfer type of this invention than for the cathode transfer type of the prior art. For example, at an auxiliary discharge current of 100 $\mu$A the floating potential of the adjacent intermediate electrode in this invention is about 6 times as high as in the prior art. As is illustrated in the figure, the rate of ionization coupling is largely dependent upon the magnitude of the auxiliary discharge current between the cathode 3 and the (N−1)-th intermediate electrode $I_{N-1}$. The rate of ionization coupling is a function of the distance between the intermediate electrodes $I_{N-1}$ and $I_N$. For a certain range of auxiliary discharge currents, as the distance becomes smaller, the rate becomes larger.

As is described above, the anode transfer type of this invention is a system in which, unlike the flickering of the auxiliary discharge glow owing to the switching of the cathode potential as in the prior art, the potential distribution on the common cathode surface is transferred by switching the potential of the intermediate electrodes, to control the distribution of electron emission from a part of the cathode surface as corresponds to the intermediate electrode. Therefore, the electrons are very easily emitted and distributed. In consequence, ionization coupling is intensified to facilitate transfer. In other words, the transfer speed can be made high.

In order to increase the scanning speed in the prior-art system, the auxiliary discharge current must be made large. In this case, the luminance of the device does not increase, and hence, the luminious efficiency decreases. On the contrary, since the auxiliary discharge current and the main discharge current are integral, in principle, in this invention, the scanning speed can be enhanced and, simultaneously, the luminance increases by making the auxiliary discharge current large, and hence, the efficiency is not lowered.

Furthermore, since the cathode 3 can be constructed of a fine wire, a high current density can be set for a certain fixed current, which is advantageous from the viewpoint of electron emission. In this manner, the flat discharge panel of this invention has many excellent points over the prior-art device.

Figure 7:
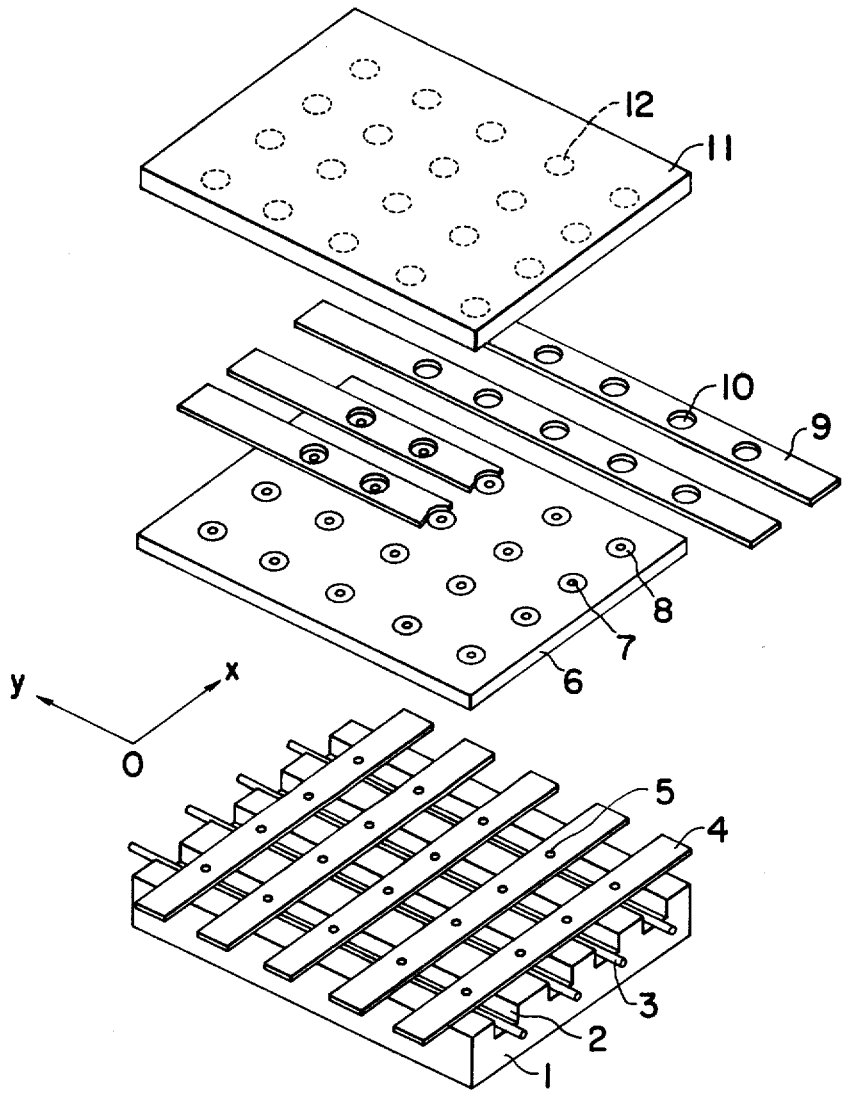
FIG. 7 is a perspective view showing the construction of an embodiment of the flat discharge panel according to this invention.

An embodiment of concrete structure of the flat discharge panel according to this invention is shown in FIG. 7. Referring to the figure, an insulating substrate 1 is provided with slots 2 for forming the auxiliary discharge spaces. Cathodes 3 are disposed in the slots 2. On the insulating substrate 1, intermediate electrodes 4 each having a number of holes 5 are disposed so as to orthogonally intersect with the cathodes 3. On the intermediate electrodes 4, an insulating plate 6 having a number of main discharge spaces 7 is disposed. Each of the main discharge spaces corresponds to one or a plurality of holes 5.

Figure 8A:
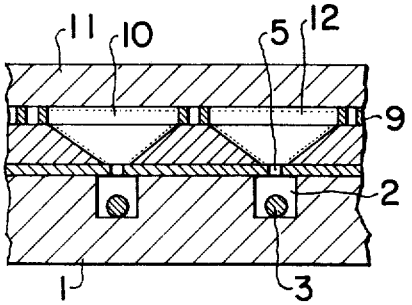
FIGS. 8*a* and 8*b* are sectional views showing the construction of another embodiment of the invention.
Figure 8B:
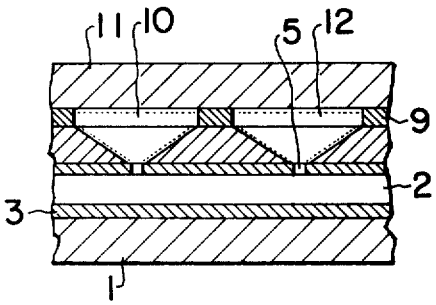

For a color display, a phosphor 8 is applied to the main discharge space region. In this case, when the main discharge space 7 is, conical as shown by sections in FIGS. 8*a* and 8*b*, the application of the phosphor is facilitated and, moreover, the directional characteristics of brilliance, etc. are enhanced. FIGS. 8*a* and 8*b* are sections in the x-and y-directions which are determined as indicated in FIG. 7, respectively.

The phosphor may be applied to those parts of the intermediate electrode 4 which face the main discharge spaces 7.

On the insulating plate 6, there are disposed anodes 9 each of which is made of, for example, a metal plate or a metal wire with display holes 10 serving also as parts of the main discharge spaces, or a light-permeable conductor. Further, a light-permeable insulating plate 11 is disposed on the anodes 9. In the case of the color display, a light-permeable phosphor 12 may be applied to the side facing the anodes 9 of the light-permeable insulating plate 11.

Although the above description has been made of the case of controlling a single main discharge by a single auxiliary discharge, it is a matter of course that a plurality of main discharges can also be controlled.

When a substance increasing the coefficient of electron emission, for example, hexafluoride or barium oxide is applied to the cathode, the electron emission becomes efficient.

In the above, description has been made of the structure of the flat discharge panel and the intermediate electrode transfer which is the fundamental driving method for the panel. Any modification of the driving system in which appropriate D.C. biases are applied to the anode and other electrodes or in which the driving pulse waveforms are changed in covered within the scope of this invention.

What I claim is:

1. A flat discharge panel comprising:

a plurality of cathodes which are parallel to one another;

a plurality of parallel intermediate electrodes the projection of each of which intersects said cathodes, each of said intermediate electrodes having priming holes respectively corresponding to its projection upon said cathodes;

parallel anodes which are disposed on the sides of said intermediate electrodes remote from said cathodes in a manner to be respectively parallel to said cathodes;

auxiliary discharge spaces provided for the corresponding cathodes and each of which is common to said intermediate electrodes;

main discharge spaces provided in said anodes in correspondence with the respective priming holes in said intermediate electrodes; and a gas which is hermetically contained in said main and auxiliary discharge spaces.

2. The flat discharge panel according to claim 1, wherein a fluorescent substance is disposed within said main discharge spaces.

3. The flat discharge panel according to claim 1, wherein a substance having a large coefficient of electron emission is disposed upon said cathodes.

4. The flat discharge panel according to claim 1, wherein said main discharge spaces are substantially conically shaped.

5. The flat discharge panel according to claim 4, wherein the diameter of said substantially conically shaped discharge spaces increases in the direction from said priming holes toward said anodes.

6. A flat discharge panel comprising:

an insulating substrate which has a plurality of slots parallel to one another, each slot forming an auxiliary discharge space;

cathodes respectively provided in said plurality of slots;

intermediate electrodes the projections of which intersect said cathodes and which have holes at the respective intersecting parts;

anodes provided in parallel to said cathodes and which are disposed in correspondence with the hole parts of said intermediate electrodes;

an insulating plate provided between said intermediate electrodes and said anodes and which has penetrating holes in places corresponding to said priming hole parts of said intermediate electrodes;

a transparent insulating substrate disposed on said anodes; and a gas hermetically contained in main discharge spaces, formed by said penetrating holes, and said auxiliary discharge spaces;

whereby electrons in an auxiliary discharge, produced in said auxiliary discharge space, diffuse into said main discharge space.

7. A flat discharge panel according to claim 6, wherein said penetrating holes in said insulating plates are substantially conically shaped.

8. A flat discharge panel according to claim 7, wherein the diameter of said penetrating holes increases in the direction from said intermediate electrodes toward said anodes.

9. A method of driving a flat discharge panel, said panel including a plurality of cathodes which are parallel to one another;

a plurality of parallel intermediate electrodes the projection of each of which intersects said cathodes, each of said intermediate electrodes having priming holes respectively corresponding to said cathodes;

parallel anodes which are arranged on the sides of said intermediate electrodes remote from said cathodes in a manner to be respectively parallel to said cathodes;

auxiliary discharge spaces provided for the corresponding cathodes and each of which is common to said intermediate electrodes;

main discharge spaces provided in said anodes in correspondence with the respective priming holes in said intermediate electrodes; and a gas which is hermetically contained in said main and auxiliary discharge spaces;

said method comprising the step of applying a predetermined D.C. voltage to said cathodes, and sequentially applying a scanning voltage to said intermediate electrodes, to transfer the glow of auxiliary discharge.

10. A method of driving a flat discharge panel, said panel including an insulating substate which has a plurality of slots parallel to one another, each slot forming an auxiliary discharge space;

cathodes which are respectively provided in said plurality of slots;

intermediate electrodes the projections of which intersect said cathodes and which have priming holes at the respective intersecting parts;

anodes provided in parallel to said cathodes and which are disposed in correspondence with the hole parts of said intermediate electrodes;

an insulating plate between said intermediate electrodes and said anodes and which has penetrating holes in places corresponding to said hole parts of said intermediate electrodes;

a transparent insulating substrate disposed on said anodes; and a gas which is hermetically contained in main discharge spaces, formed by said penetrating holes, and said auxiliary discharge spaces;

said method comprising the steps of applying a predetermined D.C. voltage to said cathodes, and sequentially applying a scanning pulse voltage to said intermediate electrodes, to transfer the glow discharge of auxiliary discharge.

* * * * *